US008662584B1

(12) United States Patent
Townsend

(10) Patent No.: US 8,662,584 B1
(45) Date of Patent: Mar. 4, 2014

(54) BE DRY BEACH TOWEL SYSTEM

(76) Inventor: Michael E. Townsend, Knoxville, TN (US)

( * ) Notice: Subject to any disclaimer, the term of this patent is extended or adjusted under 35 U.S.C. 154(b) by 142 days.

(21) Appl. No.: 13/354,758

(22) Filed: Jan. 20, 2012

(51) Int. Cl.
*A47C 31/00* (2006.01)

(52) U.S. Cl.
USPC ..... 297/229; 297/228.1; 297/31

(58) Field of Classification Search
USPC ..... 297/229, 228.13, 31
See application file for complete search history.

(56) References Cited

U.S. PATENT DOCUMENTS 4,273,380 A * 6/1981 Silvestri ..... 297/188.06
4,518,198 A * 5/1985 Daniels ..... 297/229
5,275,463 A * 1/1994 Rocha ..... 297/229
5,620,229 A * 4/1997 Ledford ..... 297/229
6,131,221 A * 10/2000 Yang ..... 5/653
6,135,635 A * 10/2000 Miller et al. ..... 383/2
6,149,234 A * 11/2000 Daniels ..... 297/229
6,626,491 B1 * 9/2003 Blome et al. ..... 297/229
2001/0035672 A1 * 11/2001 Graff ..... 297/229
2002/0063455 A1 * 5/2002 Self ..... 297/229
2007/0210628 A1 * 9/2007 Arnold ..... 297/229
2009/0322129 A1 * 12/2009 Rodill et al. ..... 297/229
2010/0001565 A1 * 1/2010 Gray et al. ..... 297/229
2011/0204687 A1 * 8/2011 Bishop ..... 297/219.12

* cited by examiner

*Primary Examiner* — David R Dunn
*Assistant Examiner* — Alexander Harrison

(57) ABSTRACT

An upper section, a lower section and an intermediate section each have top, bottom and side edges. The upper and lower sections are fabricated of a water absorbing material. The intermediate section is fabricated in an open mesh configuration of a water non-absorbing material. An upper strip of fasteners is attached to the lower edge of the upper section and the upper edge of the intermediate section. A lower strip of fasteners is attached to the lower edge of the intermediate section and the upper edge of the lower section.

1 Claim, 5 Drawing Sheets

BE DRY BEACH TOWEL SYSTEM

BACKGROUND OF THE INVENTION

Field of the Invention

The present invention relates to a be dry beach towel system and more particularly pertains to providing upper and lower absorbent sections with an absorbent intermediate section there between, and for selectively coupling the upper and lower sections to optionally expose the conceal the intermediate section, the providing and coupling and exposing and concealing being done in a safe, convenient and economical manner.

SUMMARY OF THE INVENTION

In view of the disadvantages inherent in the known types of towel systems of known designs and configurations now present in the prior art, the present invention provides an improved be dry beach towel system. As such, the general purpose of the present invention, which will be described subsequently in greater detail, is to provide a new and improved be dry beach towel system and method which has all the advantages of the prior art and none of the disadvantages.

To attain this, the present invention essentially comprises a be dry beach towel system. First provided are an upper section and a lower section and an intermediate section. Each section has top and bottom and side edges. The upper and lower sections are fabricated of a water absorbing material. The intermediate section is fabricated in an open mesh configuration of a water non-absorbing material. An upper strip of fasteners and a lower strip of fasteners are provided. The upper strip of fasteners is attached to the lower edge of the upper section and the upper edge of the intermediate section. The lower strip of fasteners is attached to the lower edge of the intermediate section and the upper edge of the lower section.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved be dry beach towel system which has all of the advantages of the prior art towel systems of known designs and configurations and none of the disadvantages.

It is another object of the present invention to provide a new and improved be dry beach towel system which may be easily and efficiently manufactured and marketed.

It is further object of the present invention to provide a new and improved be dry beach towel system which is of durable and reliable constructions.

An even further object of the present invention is to provide a new and improved be dry beach towel system which is susceptible of a low cost of manufacture with regard to both materials and labor, and which accordingly is then susceptible of low prices of sale to the consuming public, thereby making such be dry beach towel system economically available to the buying public.

Even still another object of the present invention is to provide a be dry beach towel system for providing upper and lower absorbent sections with an absorbent intermediate section there between, and for selectively coupling the upper and lower sections to optionally expose the conceal the intermediate section, the providing and coupling and exposing and concealing being done in a safe, convenient and economical manner.

Lastly, it is an object of the present invention to provide a new and improved be dry beach towel system. An upper section, a lower section and an intermediate section are provided. Each section has top, bottom and side edges. The upper and lower sections are fabricated of a water absorbing material. The intermediate section is fabricated in an open mesh configuration of a water non-absorbing material. An upper strip of fasteners is attached to the lower edge of the upper section and the upper edge of the intermediate section. A lower strip of fasteners is attached to the lower edge of the intermediate section and the upper edge of the lower section.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various Figures.

DESCRIPTION OF THE PREFERRED EMBODIMENT

Figure 1:
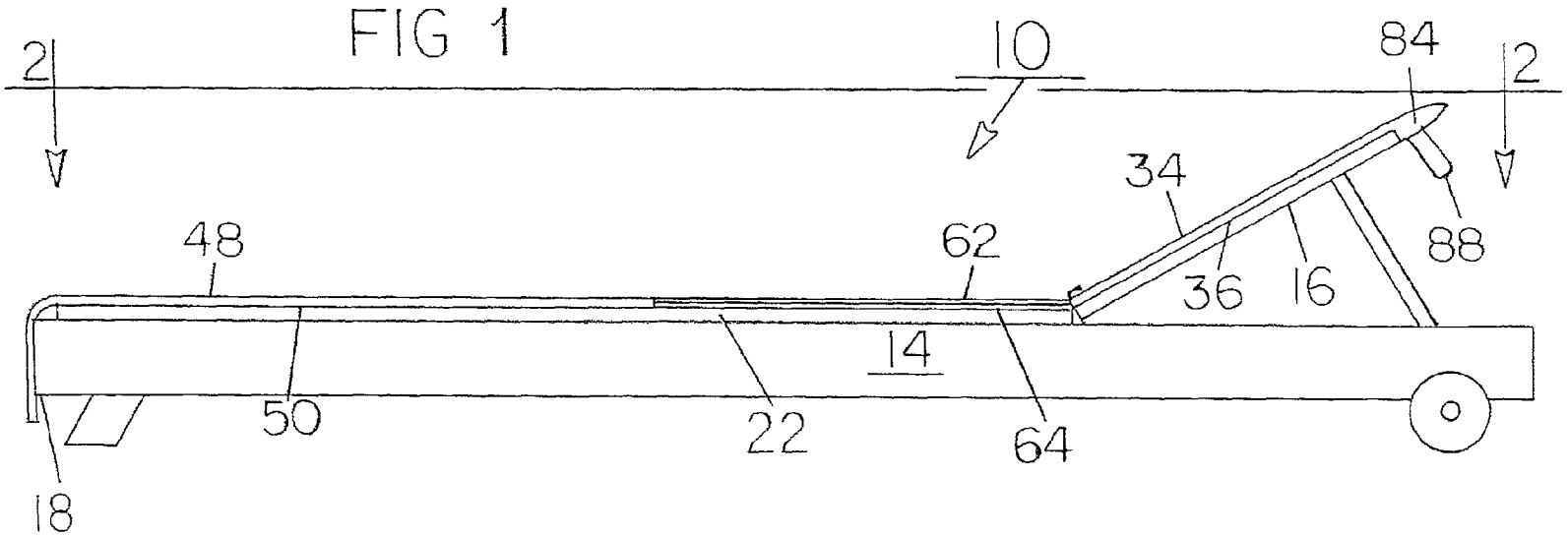
FIG. 1 is a side elevational view of a be dry beach towel system constructed in accordance with the principles of the present invention.
Figure 2:
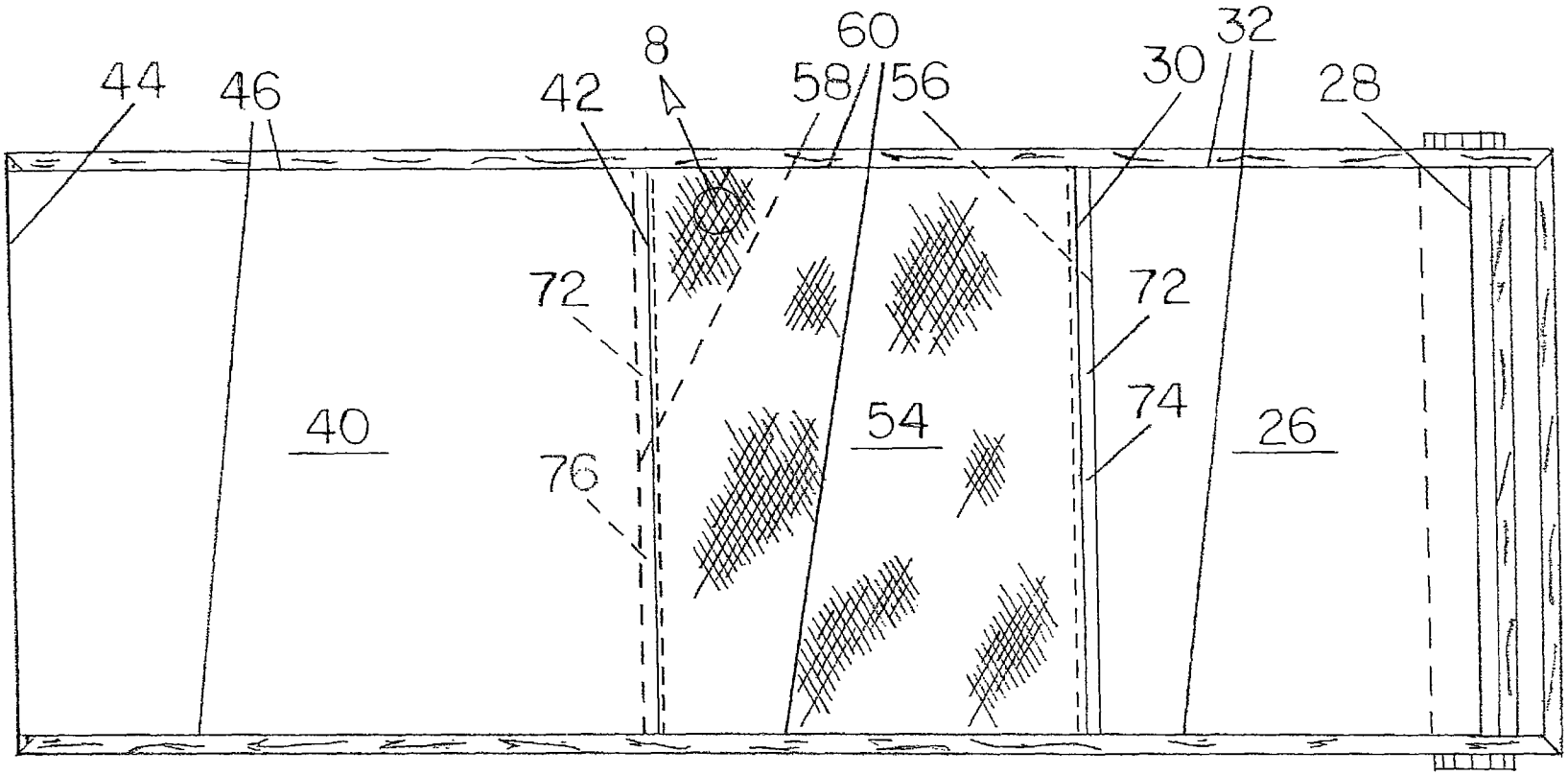
FIG. 2 is a plan view of the system taken along line 2-2 of FIG. 1.
Figure 3:
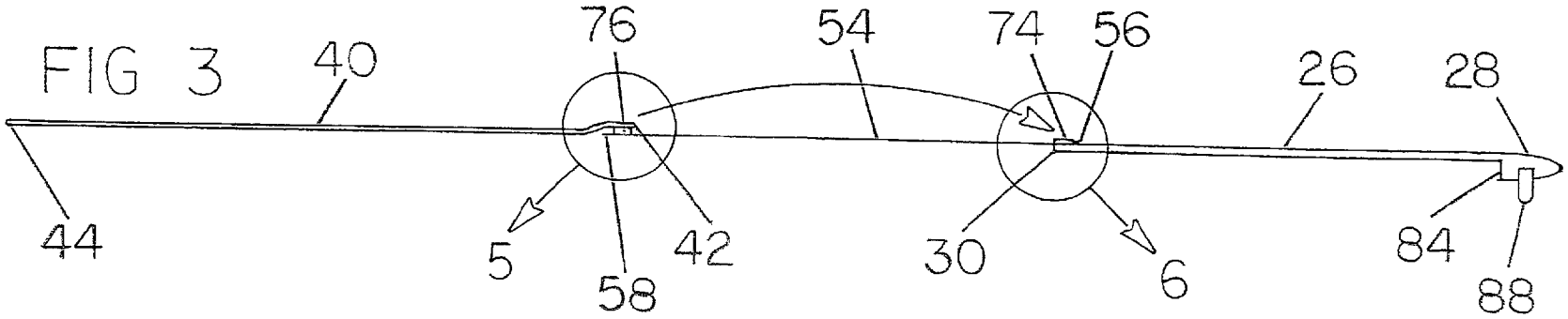
FIG. 3 is a side elevational view of the system similar to FIG. 1 but with the lounge chair removed, the system being in the extended orientation.
Figure 4:
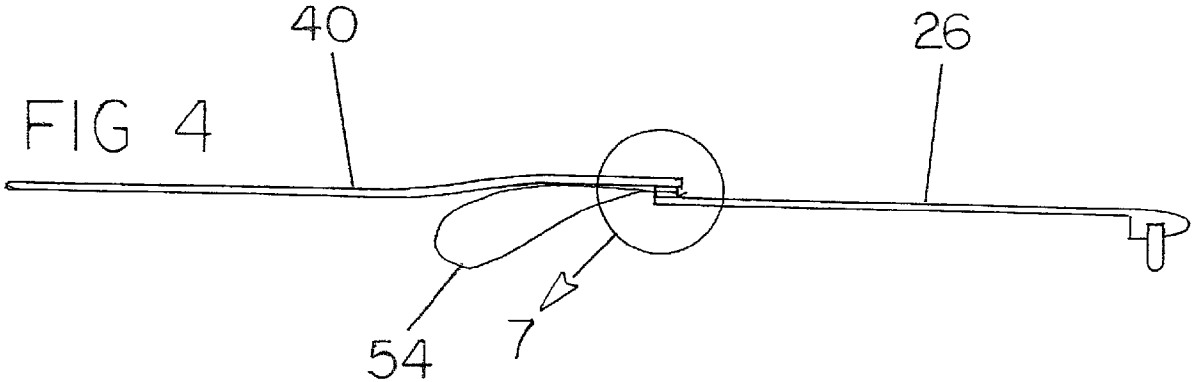
FIG. 4 is a side elevational view of the system similar to FIG. 3 but with the system being in the contracted orientation.
Figure 6:
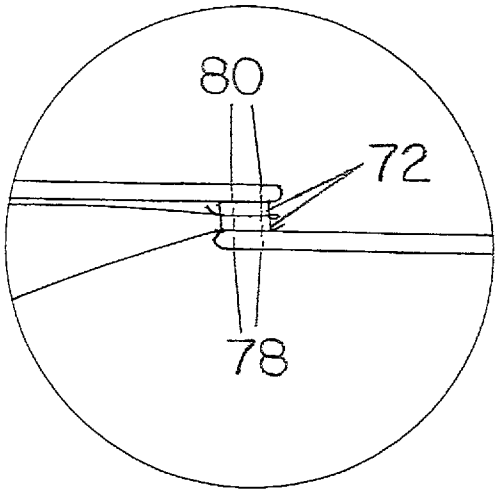
FIGS. 5, 6 and 7 are enlarged side elevational views taken at circles 5, 6 and 7 of FIGS. 3 and 4.
Figure 5:
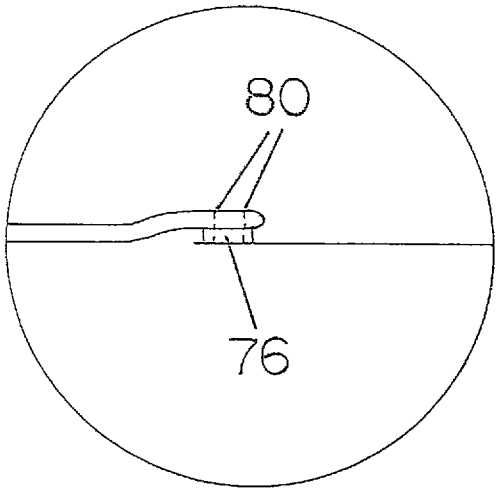
Figure 8:
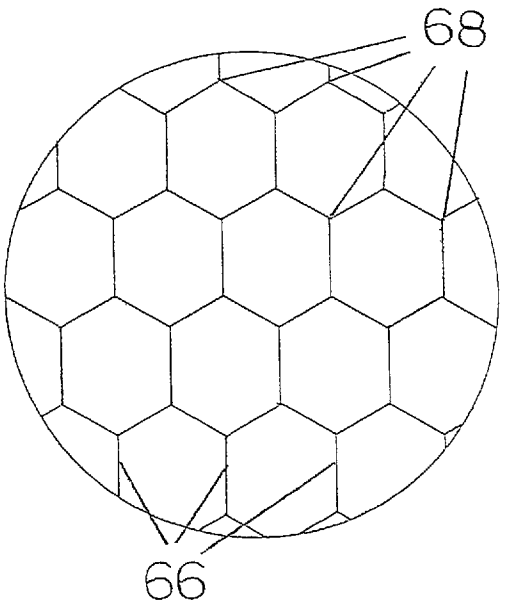
FIG. 8 is an enlarged plan view taken at circle 8 of FIG. 2.
Figure 7:
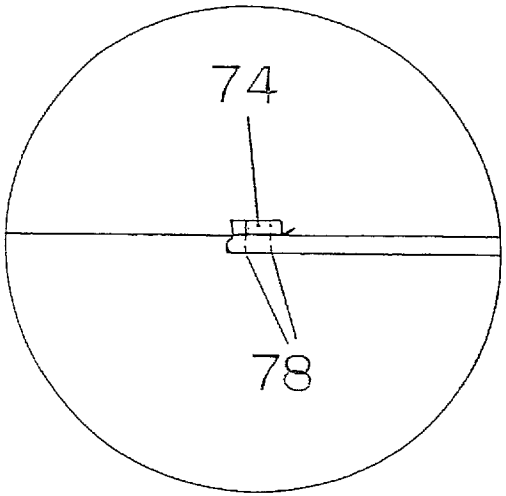

With reference now to the drawings, and in particular to FIG. 1 thereof, the preferred embodiment of the new and improved be dry beach towel system embodying the principles and concepts of the present invention and generally designated by the reference numeral 10 will be described.

The present invention, the be dry beach towel system 10 is comprised of a plurality of components. Such components in their broadest context include an upper section, a lower section, an intermediate section, an upper strip of fasteners and a lower strip of fasteners. Such components are individually configured and correlated with respect to each other so as to attain the desired objective.

First provided is a chaise lounge 14. The chaise lounge has a head edge 16. The chaise lounge has a parallel foot edge 18. The head and foot edges are separated by a length of 7 feet plus or minus 20 percent. The chaise lounge has parallel side edges 20. The side edges are provided between the upper and lower edges. The side edges are separated by a width of 1.5 feet plus or minus 20 percent. The chaise lounge has a user support surface 22. The user support surface is provided between the head and foot and side edges.

An upper towel section 26 is provided. The upper towel section has a top edge 28. The upper towel section has a parallel bottom edge 30. The top and bottom edges are separated by a length of 2 feet plus or minus 20 percent. The upper towel section has parallel side edges 32. The side edges are provided between the upper and lower edges. The side edges are separated by a width of 1.5 feet plus or minus 20 percent. The upper towel section has upper and lower surfaces 34, 36. The upper towel section is fabricated of a water absorbing Turkish towel material.

A lower towel section 40 is provided. The lower towel section has a top edge 42. The lower towel section has a parallel bottom edge 44. The top and bottom edges are separated by a length of 2.5 feet plus or minus 20 percent. The lower towel section has parallel side edges 46. The side edges are provided between the upper and lower edges. The side edges are separated by a width of 1.5 feet plus or minus 20 percent. The upper towel section has upper and lower surfaces 48, 50. The lower towel section is fabricated of a water absorbing Turkish towel material.

An intermediate section 54 is provided. The intermediate section has a top edge 56. The intermediate section has a parallel bottom edge 58. The top and bottom edges are separated by a length of 2 feet plus or minus 20 percent. The intermediate section has parallel side edges 60. The side edges are provided between the upper and lower edges. The side edges are separated by a width of 1.5 feet plus or minus 20 percent. The upper intermediate section has upper and lower surfaces 62, 64. The intermediate section is fabricated of plastic fibers, preferably nylon or polyester. The plastic fibers are provided in an open mesh hexagonal shape. The plastic fibers have water non-absorbing properties. The mesh has lateral sides 66. The sides are separated by a width of between 0.010 and 0.020 inches. The mesh has longitudinal points 68. The longitudinal points are separated by a length of between 0.020 and 0.030 inches.

A hook and loop assembly 72 is provided next. The hook and loop assembly is formed of an upper strip 74 of loop fasteners and a lower strip 76 of hook fasteners. The hook and loop assembly has upper stitching 78. In the manner the upper strip is attached to the upper surface of the upper section adjacent to the lower edge of the upper section. The upper edge of the intermediate section is provided between the upper strip and the upper section. The hook and loop assembly has lower stitching 80. In this manner, the lower strip is attached between the upper surface of the intermediate section adjacent to the lower edge of the intermediate section and the lower surface of the lower section adjacent to the upper edge of the lower section. The hook and loop assembly is adapted to configured in an extended orientation. In the extended orientation, the upper and lower strips are separated. In this manner a user's mid-section and wet swim trunks are over the intermediate section. The hook and loop assembly is further adapted to be configured in a contracted orientation. In the contracted orientation, the upper and lower strips are coupled with the intermediate section depending from the hook and loop assembly. Two layers of intermediate section are provided between the upper and lower strips.

Further provided is a pocket. The pocket is formed from a smaller section 84 of a water absorbing Turkish towel material. The smaller section is coupled to the lower surface of the upper section. The smaller section has a top edge. The smaller section has a parallel free bottom edge. The top and bottom edges are separated by a length of between 2 and 6 inches. The top edge of the smaller section is coupled to the top edge of the upper section. The upper towel section has parallel side edges. The side edges are stitched to the side edges of the upper section. The pocket receives the head edge of the chase lounge when in use. The pocket is adapted to be turned inside out with upper and intermediate and lower sections rolled up and tucked in the pocket during storage.

Provided last is a carrying strap 88. The carry strap has end edges. The end edges are stitched to the side edges of the upper and smaller sections. In this manner carrying is facilitated when rolled up and tucked in the pocket. The side edges of the carrying strap are spaced by a distance greater than the distance between the side edges of the upper section and smaller section.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A be dry beach towel system (10) for providing upper and lower absorbent sections with a non-absorbent intermediate section there between, and for selectively coupling the upper and lower sections to optionally expose and conceal the intermediate section, the providing and coupling and exposing and concealing being done in a safe, convenient and economical manner, the system comprising, in combination:

a chaise lounge (14) having a head edge (16) and a parallel foot edge (18) separated by a length of 7 feet plus or minus 20 percent, the chaise lounge having parallel side edges (20) between the upper and lower edges separated by a width of 1.5 feet plus or minus 20 percent, a user support surface (22) between the head and foot and side edges, an upper towel section (26) having a top edge (28) and a parallel bottom edge (30) separated by a length of 2 feet plus or minus 20 percent, the upper towel section having parallel side edges (32) between the upper and lower edges separated by a width of 1.5 feet plus or minus 20 percent, the upper towel section having upper and lower surfaces (34), (36), the upper towel section being fabricated of a water absorbing Turkish towel material;

a lower towel section (40) having a top edge (42) and a parallel bottom edge (44) separated by a length of 2.5 feet plus or minus 20 percent, the lower towel section having parallel side edges (46) between the upper and lower edges separated by a width of 1.5 feet plus or minus 20 percent, the upper towel section having upper and lower surfaces (48)(50), the lower towel section being fabricated of a water absorbing Turkish towel material;

an intermediate section (54) having a top edge (56) and a parallel bottom edge (58) separated by a length of 2 feet plus or minus 20 percent, the intermediate section having parallel side edges (60) between the upper and lower edges separated by a width of 1.5 feet plus or minus 20 percent, the upper intermediate section having upper and lower surfaces (62), (64), the intermediate section being fabricated of plastic fibers in an open mesh hexagonal shape with water non-absorbing properties, the mesh having lateral sides (66) separated by a width of between 0.010 and 0.020 inches, the mesh having longitudinal points (68) separated by a length of between 0.020 and 0.030 inches;

a hook and loop assembly (72) formed of an upper strip (74) of loop fasteners and a lower strip (76) of hook fasteners, upper stitching (78) attaching the upper strip to the upper surface of the upper section adjacent to the lower edge of the upper section with the upper edge of the intermediate section between the upper strip and the upper section, lower stitching (80) attaching the lower strip between the upper surface of the intermediate section adjacent to the lower edge of the intermediate section and the lower surface of the lower section adjacent to the upper edge of the lower section, the hook and loop assembly adapted to configured in an extended orientation with the upper and lower strips separated whereby a user's mid-section and wet swim trunks are over the intermediate section, the hook and loop assembly adapted to configured in a contracted orientation with the upper and lower strips coupled with the intermediate section depending from the hook and loop assembly and with two layers of intermediate section between the upper and lower strips;

a pocket formed of a smaller section (84) of a water absorbing Turkish towel material coupled to the lower surface of the upper section, the smaller section having a top edge and a parallel free bottom edge separated by a length of between 2 and 6 inches, the top edge of the smaller section coupled to the top edge of the upper section, the upper towel section having parallel side edges stitched to the side edges of the upper section, the pocket receiving the head edge of the chaise lounge when in use, the pocket adapted to be turned inside out with upper and intermediate and lower sections rolled up and tucked in the pocket during storage; and a carrying strap (88) having end edges stitched to the side edges of the upper and smaller sections to facilitate carrying when rolled up and tucked in the pocket, the side edges of the carrying strap being spaced by a distance greater than the distance between the side edges of the upper section and smaller section.

* * * * *